US009234316B2

(12) United States Patent
Wadensten

(10) Patent No.: US 9,234,316 B2
(45) Date of Patent: Jan. 12, 2016

(54) VIBRATORY POTHOLE PACKER

(71) Applicant: Vibco, Inc., Wyoming, RI (US)

(72) Inventor: Theodore S. Wadensten, Charlestown, RI (US)

(73) Assignee: VIBCO, INC., Wyoming, RI (US)

( * ) Notice: Subject to any disclaimer, the term of this patent is extended or adjusted under 35 U.S.C. 154(b) by 0 days.

(21) Appl. No.: 14/614,101

(22) Filed: Feb. 4, 2015

(65) Prior Publication Data

US 2015/0337502 A1 Nov. 26, 2015

Related U.S. Application Data

(60) Provisional application No. 62/001,808, filed on May 22, 2014.

(51) Int. Cl.

| | |
|---|---|
| ***E01C 19/00*** | (2006.01) |
| ***E01C 19/26*** | (2006.01) |
| ***E01C 19/23*** | (2006.01) |
| ***E01C 19/24*** | (2006.01) |
| ***E01C 19/28*** | (2006.01) |

(52) U.S. Cl.

CPC ..... *E01C 19/262* (2013.01); *E01C 19/23* (2013.01); *E01C 19/238* (2013.01); *E01C 19/24* (2013.01); *E01C 19/283* (2013.01); *E01C 19/286* (2013.01)

(58) Field of Classification Search

USPC ..... 404/97, 113, 117

See application file for complete search history.

(56) References Cited

U.S. PATENT DOCUMENTS 1,650,574 A * 11/1927 Stubbs ..... E01C 19/281 404/117
4,647,247 A * 3/1987 Sandstrom ..... E01C 19/286 172/40
5,244,306 A * 9/1993 Artzberger ..... E02F 3/967 37/403
5,480,259 A * 1/1996 Thrower ..... E04F 21/24 404/117
5,803,656 A * 9/1998 Turck ..... E04F 21/24 404/103
6,200,066 B1 * 3/2001 Humphrey ..... A01B 29/06 404/117
6,409,425 B1 * 6/2002 Okabe ..... E01C 19/283 404/117
6,837,648 B1 * 1/2005 Wadensten ..... E01C 19/283 404/117
7,080,955 B2 * 7/2006 Gregg ..... E01C 19/43 404/122
7,588,389 B1 * 9/2009 Humphrey ..... A01B 29/06 404/117
8,100,603 B2 * 1/2012 Sampson ..... E01C 19/238 404/131
8,186,906 B2 * 5/2012 Zimmerman ..... E04G 21/10 404/117
8,297,878 B2 * 10/2012 Goodman ..... E01C 19/236 404/119
8,414,220 B1 * 4/2013 Koba ..... E01C 19/281 404/117
8,727,660 B2 * 5/2014 Anderegg ..... E02D 3/074 404/117

* cited by examiner

*Primary Examiner* — Raymond W Addie

(74) *Attorney, Agent, or Firm* — Barlow, Josephs & Holmes, Ltd.

(57) ABSTRACT

A vibratory pothole packer includes a frame that supports an engine and a rotatable drum, and a rotatable eccentric shaft is supported within the drum. The eccentric shaft may be a drum shaft with a mass welded to its surface. The eccentric shaft is supported within the drum by bearings, and is also supported on the frame by bearings. The engine shaft can be selectively linked with eccentric shaft to selectively effect vibrational rotation of the eccentric shaft. The small, lightweight pothole packer is manually movable on a surface by one person, and can be moved along a surface either while the eccentric shaft rotates or while the eccentric shaft is not rotating. The center of mass of the eccentric shaft is offset towards one end of the shaft to allow the vibratory pothole packer to be easily moved in a straight line along a surface.

16 Claims, 6 Drawing Sheets

VIBRATORY POTHOLE PACKER

CROSS REFERENCE TO RELATED APPLICATION

This application is related to and claims priority to earlier filed U.S. provisional patent application 62/001,808, filed May 22, 2014, the entire contents thereof is incorporated herein by reference.

BACKGROUND OF THE INVENTION

The present invention relates to a vibratory roller. More specifically, the present invention relates to a vibratory roller that is configured for use in compacting asphalt in potholes, and that is configured to be hand-operated and to be maneuvered by a human.

Vibratory rollers are used in the construction industry, compacting sand, gravel and asphalt in the construction of roads, parking lots and driveways. There are several types of vibratory rollers. They can be divided into two general groups. The first group includes self-propelled double drum units where the operator sits on a platform operating the vibratory element as well as the forward and reverse movement, namely, the direction in which the unit is travelling. The other group is the walk-behind type where the operator walks behind the roller controlling the vibratory element as well as the forward and reverse movement of the unit. These units are in the range of several hundred to thousands of pounds in weight, and are more suitable for large road repairs rather than for small potholes. There has been a need for a smaller, easy to maneuver, and lightweight vibratory roller for small repairs and primarily for compacting asphalt in potholes.

For small jobs, such as filling an individual pothole in a section of a roadway, it is well known in the industry that workers can try to compact asphalt in the pothole by hand, but this is ineffective. The usual method of pothole repair uses asphalt supplied from the bed of a truck, such as a truck operated by a department of transportation or another work crew. A person with a shovel typically walks behind the truck and fills the potholes with asphalt. He then flattens out the asphalt by hitting it with the shovel a few times in an attempt to pack down the asphalt. However, this method does not result in sufficient compacting of the asphalt. After a few cars and trucks have passed over the pothole the asphalt is pushed out, and usually a larger pothole is created, so the site of the pothole needs to be repaired again. Eventually, as the first pothole gets bigger, and as there are more potholes near the first pothole, the road has to be repaved. If the potholes are compacted properly, they will last as long as the rest of the asphalted surface, which eliminates the time and expense associated with improper repair of the pothole.

In view of the above, there is a need for an improved pothole packer that is well-suited for smaller jobs and is easier to operate.

SUMMARY OF THE INVENTION

The present invention provides a small vibratory pothole packer, which is small and light, so the vibratory pothole packer is easily portable in a cost-effective manner between small jobs that require filling one pothole or only a few potholes.

The exemplary embodiment of the vibratory pothole packer of the present invention is configured for one-man operation, is lightweight, is self-propelled, and is configured to support a water tank. It preferably provides 1600 pounds force and 8 inches of compaction depth but can be modified, as desired.

The exemplary embodiment of the vibratory pothole packer of the present invention provides a pothole packer with smaller overall dimensions and a lower weight compared to typical vibratory rollers that are used for compacting asphalt in a section of a roadway. The vibratory pothole packer includes a substantially cylindrical drum that a user can selectively vibrate to compact asphalt underneath the drum. The weight of the pothole packer and the frequency at which the drum can vibrate are designed to be within ranges that allow a user to effectively compact asphalt within a pothole to maximize the amount of time before the pothole will require further repair.

The exemplary embodiment further includes a frame that has an outer wall secured to a mounting channel. The outer frame wall includes at least one side plate. The mounting channel supports an engine that outputs power through an engine shaft for powering the eccentric shaft of the vibratory pothole packer, as discussed in more detail below.

The vibratory pothole packer of the present invention engages asphalt on the ground by way of a drum that is secured to the frame. The drum, or roller, has an outer wall with a substantially cylindrical outer surface, so that it can roll along a surface such as a roadway. The outer wall has an inner surface that defines a cavity within the drum.

An eccentric shaft extends within the cavity of the drum, and the engine powers the eccentric shaft. The eccentric shaft has a first end and a second end, and the eccentric mass of the eccentric shaft is positioned closer to the first end than to the second end, and is positioned closer to a first end of the drum than to the second. The eccentric shaft is rotatably supported within the drum by at least one drum bearing that is secured to the drum, preferably to the inner surface of the drum. Preferably there are two drum bearings, each located towards opposite ends of the drum to engage the eccentric shaft towards opposite ends of the eccentric shaft. Thus, the eccentric shaft can rotate with respect to the drum.

The drum is rotatably secured to the frame by way of the eccentric shaft, which is supported by a shock absorbing structure on the frame. The shock absorbing structure includes at least one shock absorber plate that is secured to each side plate of the frame by one or more shock absorbers. A shock absorber plate bearing is secured to each shock absorber plate. Each shock absorber plate bearing is dimensioned and configured for receiving and rotatably supporting the eccentric shaft with respect to the frame. Vibration of the eccentric shaft, discussed below, can be transferred to the shock absorber bearings, but the shock absorber plate and shock absorbers reduce the amount of vibration that is transferred from the eccentric shaft to the frame, the engine, and a user touching either the frame or the engine.

Rotation of the eccentric shaft at certain frequencies produces vibration of the eccentric shaft and the drum. To cause rotation of the eccentric shaft, a user can selectively link the rotation of the engine shaft to the rotation of the eccentric shaft. For this purpose, a sheave is secured to the eccentric shaft. The sheave has an outer surface that engages an inner surface of a v-belt that extends at least partially around the outer surface of the sheave. A centrifugal clutch is secured to the engine shaft, and it is engaged when the engine shaft operates at or above a critical speed. An outer surface of the centrifugal clutch engages the inner surface of the v-belt. Thus, when the centrifugal clutch is engaged, rotation of the outer surface of the centrifugal clutch is linked to rotation of the engine shaft, so that rotation of the eccentric shaft is linked to rotation of the engine shaft by way of the v-belt. Engagement of the v-belt with the centrifugal clutch and/or the sheave can be by friction, or another means.

When a user is ready to use the vibratory pothole packer, the user prepares the pothole in the road surface by removing debris from the pothole, places asphalt within the pothole, places the drum of the vibratory pothole packer onto the paved surface, and then turns the engine from an off setting to an on setting. When the user is ready to pack the asphalt into the pothole, the user increases the engine speed from an idling speed to a speed at or above the critical speed. Then the centrifugal clutch is engaged, and rotation of the centrifugal clutch causes rotation of the v-belt, which causes rotation of the sheave and the eccentric shaft to effectuate the vibratory action.

The user can operate an engine speed control to adjust the engine speed from the idling speed to the critical speed, and back to the idling speed, as needed.

This engine speed control is preferably located on a handle assembly that is secured to the mounting channel of the frame. The handle assembly includes a substantially horizontal handlebar that is set at a height where it can be comfortably gripped by a user. The handlebar allows the user to steer the vibratory pothole packer left or right on a surface.

The handle assembly also supports a kickstand, which is selectively pivotable to an orientation in which it supports the vibratory pothole packer in an upright position. The kickstand is also pivotable to a retracted orientation in which it allows a user to easily maneuver the vibratory pothole packer along a surface such as a paved roadway.

During operation of the vibratory pothole packer, directing water onto the outer surface of the drum helps to prevent asphalt from sticking to the outer surface of the drum. The vibratory pothole packer is configured to carry water, or another fluid, in a fluid tank. The fluid tank is secured to the mounting channel of the frame for containing fluid to be dispensed onto the drum of the vibratory pothole packer. A sprinkler pipe is secured to the mounting channel and is adjacent to the drum. Fluid can be guided from the reservoir of the fluid tank, through a spout in the tank, then through a hose, and into the sprinkler pipe. The fluid is then directed from the sprinkler pipe onto the drum or onto the asphalt being packed by the drum, as the fluid exits the sprinkler pipe through holes that are defined on the outer surface of the sprinkler pipe.

When a user does not want to direct fluid from the fluid tank onto the drum or the asphalt, the user can set a shutoff valve to an off position. This shutoff valve is preferably connected at one end to the hose and at the other end to the sprinkler pipe.

The eccentric shaft can be formed integrally as a shaft that has a center of mass that is offset from its longitudinal center, so the center of mass of the eccentric shaft is longitudinally offset from the center of the drum. It can also be formed as a substantially uniform, substantially cylindrical drum shaft that has an eccentric mass secured to the outer surface of the drum shaft so the center of mass of the eccentric mass is longitudinally offset from the center of mass of the drum shaft. The eccentric mass can be secured to the drum shaft by various methods, such as welding.

The shock absorbers may be made of various materials, and may include rubber or be made entirely from rubber.

Accordingly, among the objects of the instant invention are: the provision of a vibratory pothole packer that is small and easily portable to work sites where only a single pothole needs to be filled; the provision of a vibratory pothole packer that is cost-effectively transportable to work sites where only a single pothole needs to be filled; the provision of a vibratory pothole packer that can be easily maneuvered by a single person; the provision of a vibratory pothole packer that provides a smooth upper surface of asphalt packed in a pothole; the provision of a vibratory pothole packer that is biased towards movement in a substantially straight path along a surface when a user pushes or pulls the pothole packer along the surface; and the provision of a vibratory pothole packer that sufficiently compacts asphalt within a pothole to maximize the life length of time before the pothole will require further repair. Other objects, features and advantages of the invention shall become apparent as the description thereof proceeds when considered in connection with the accompanying illustrative drawings.

BRIEF DESCRIPTION OF THE DRAWINGS

The novel features that are characteristic of the present invention are set forth in the appended claims. However, the invention's preferred embodiments, together with further objects and attendant advantages, will be best understood by reference to the following detailed description taken in connection with the accompanying Figures in which:

DETAILED DESCRIPTION OF THE PREFERRED EMBODIMENT

Figure 1:
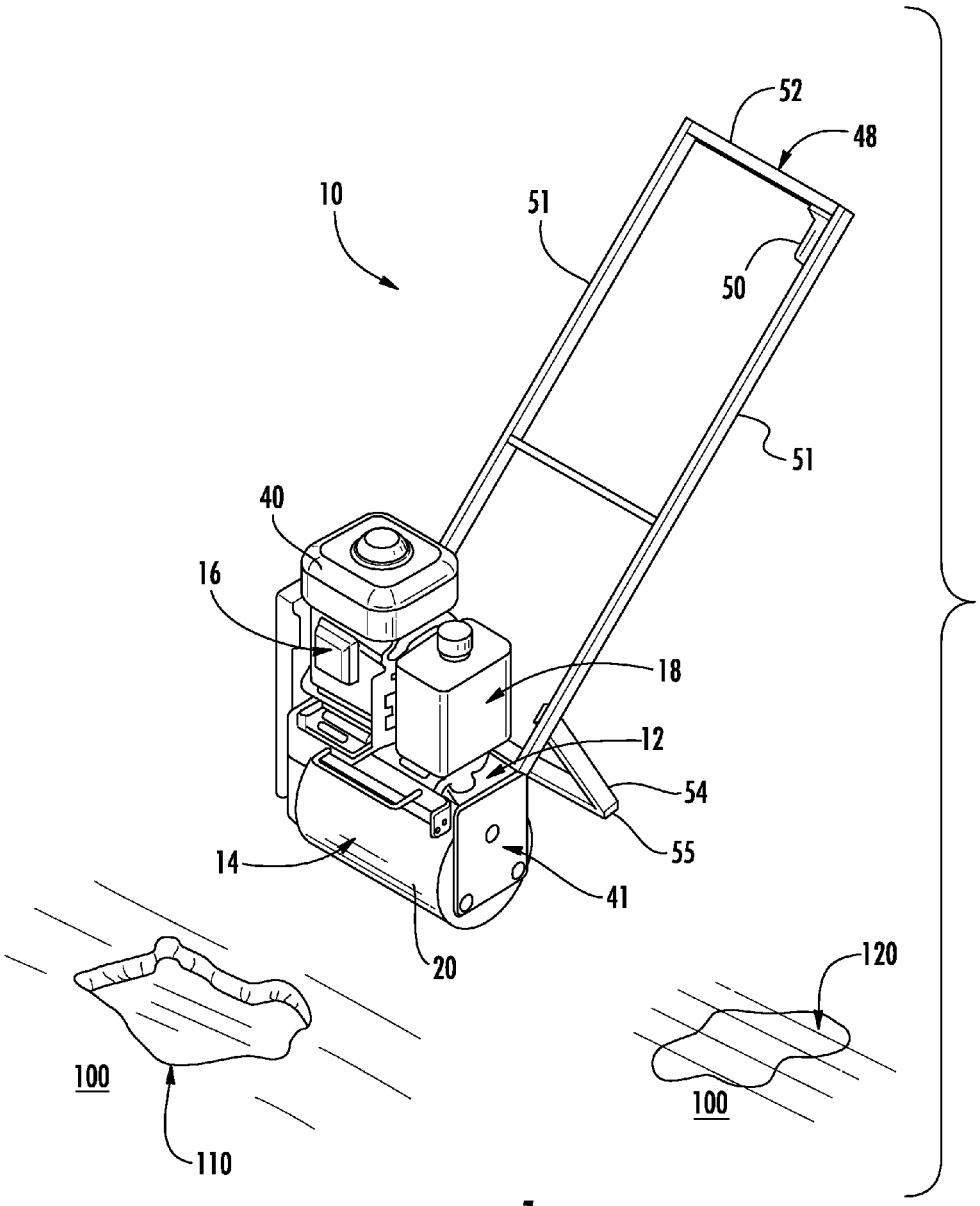
FIG. 1 is a perspective view of an exemplary embodiment of the vibratory pothole packer of the present invention.

Referring now to the drawings, the vibratory pothole packer of the instant invention is illustrated and generally indicated at 10 in FIGS. 1-6. As will hereinafter be more fully described, the vibratory pothole packer provides a small, easily portable pothole packer for effectively and easily packing asphalt into potholes in a roadway.

Generally, the vibratory pothole packer 10 of the present invention allows a user to easily fill a pothole 110 in a roadway 100 with asphalt so that the asphalt is sufficiently and evenly compacted within the pothole 110, and so the compacted asphalt has a smooth upper surface, to maximize the amount of time before the pothole will require further repair. FIG. 1 shows a pothole 110 that needs to be filled. FIG. 1 also shows a pothole 120 that has been filled with asphalt, and the asphalt has been compacted with the vibratory pothole packer 10 of the present invention. The upper surface of the asphalt in the filled pothole 120 forms a smooth, continuous upper surface with the upper surface of the road 100. The vibratory pothole packer is configured to be lightweight, compact in size, and easily maneuverable by hand. The pothole packer 10 is configured so that it has a tendency to travel in a straight line along a surface.

A preferred embodiment of the vibratory pothole packer of the present invention is shown in FIG. 1. The vibratory pothole packer 10 includes a frame and handle assembly 12, a vibratory drum assembly 14, an engine and drive assembly 16, and a water tank and sprinkler system 18. The components of these assemblies 12, 14, 16, 18 are secured together in a compact manner so the vibratory pothole packer 10 is sufficiently small and lightweight that a typical individual working on a road repair work crew can move the vibratory pothole packer along a surface such as a roadway or another paved surface.

When a user is ready to compact asphalt in a pothole, the user manipulates the frame and handle assembly 12 to guide the vibratory pothole packer 10 along the paved surface, such as a roadway 100. The user manually controls the vibratory pothole packer 10 through a frame and handle assembly 12 to move the vibratory pothole packer 10 in forward and reverse directions, and the vibratory pothole packer preferably does not include a forward and reverse mechanism that is not manually powered. Excluding a forward and reverse drive mechanism reduces the weight and size of the vibratory pothole packer 10, making it more maneuverable and portable. Instead, the pothole packer 10 includes a frame and handle assembly 12 that allows a user to push or pull the pothole packer along a surface, such as a roadway 100. The centrifugal force created by the pothole packer helps the pothole packer to move in a forward direction, and very little manual force is necessary in moving the unit. To move the pothole packer 10 in a reverse direction, it is pulled by the user against these centrifugal forces. Such centrifugal forces are small enough that they can be easily overcome for this reverse direction movement, when desired.

The engine and drive assembly 16 can be selectively controlled to actuate components of the vibratory drum assembly 12. The water tank and sprinkler system 18 provides water to the vibratory drum assembly.

The operation and interaction of these components is described in further detail herein.

Figure 2:
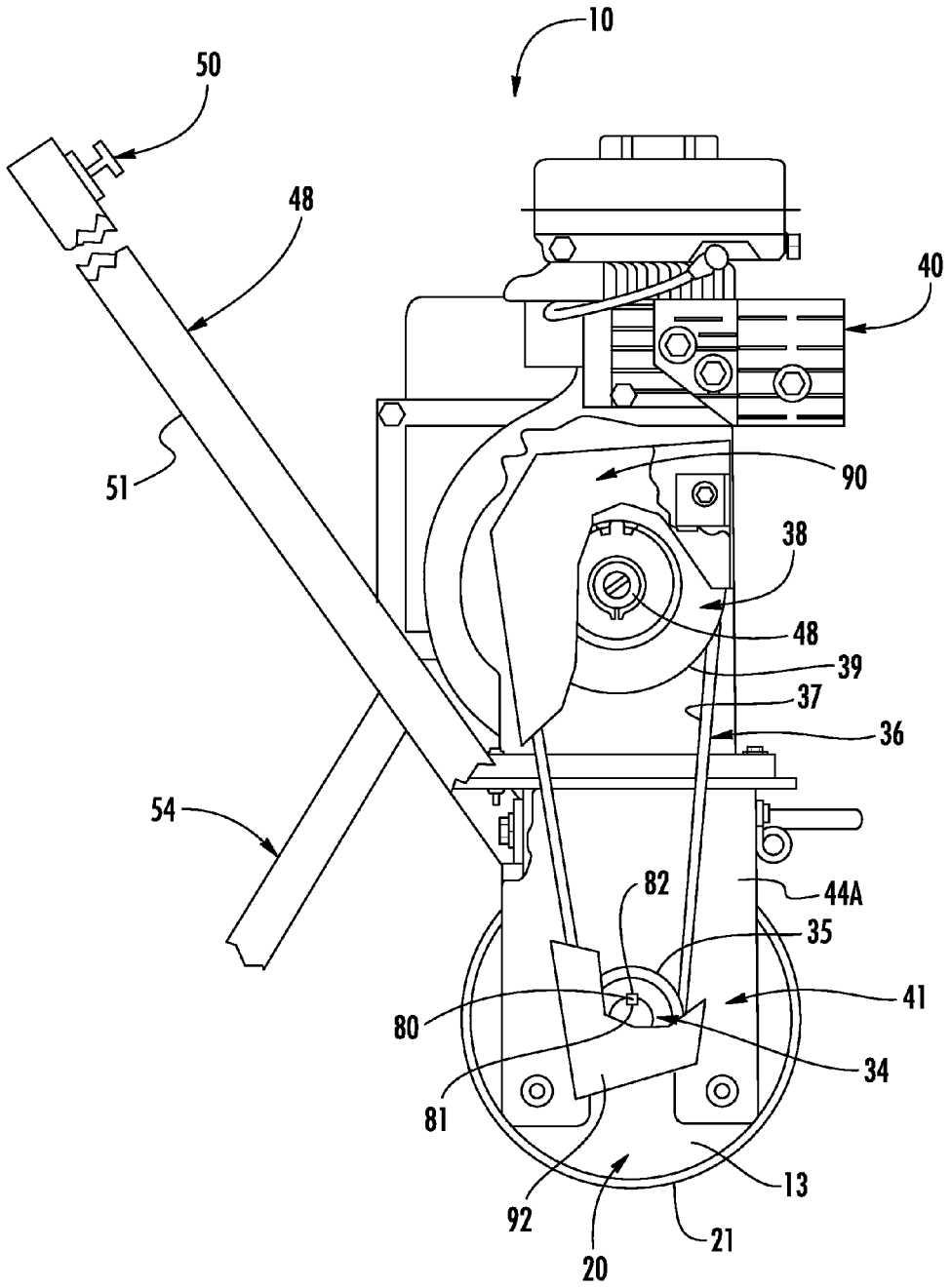
FIG. 2 is a side, partial cutaway view thereof.
Figure 3A:
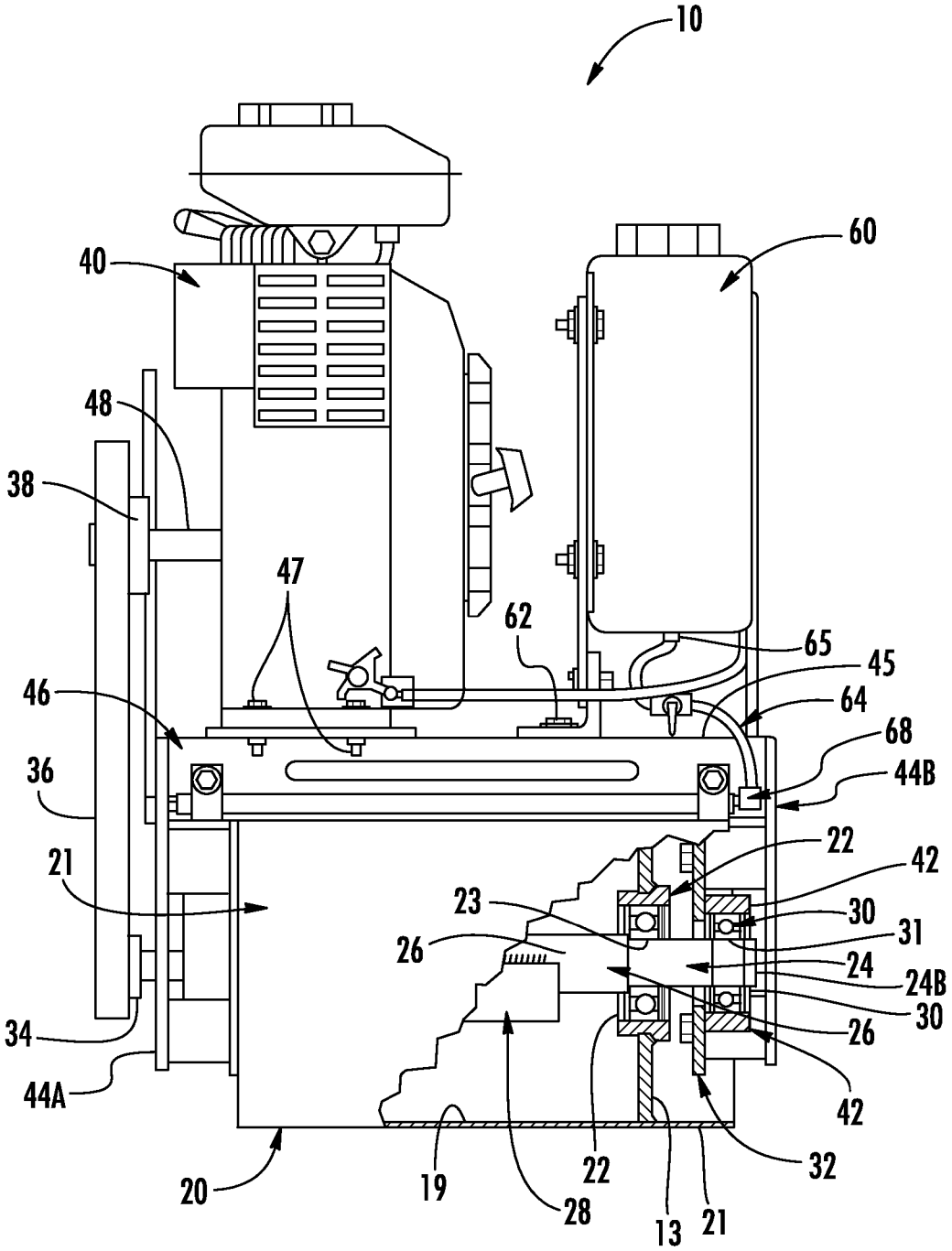
FIG. 3A is a front, partial cutaway view thereof.
Figure 3B:
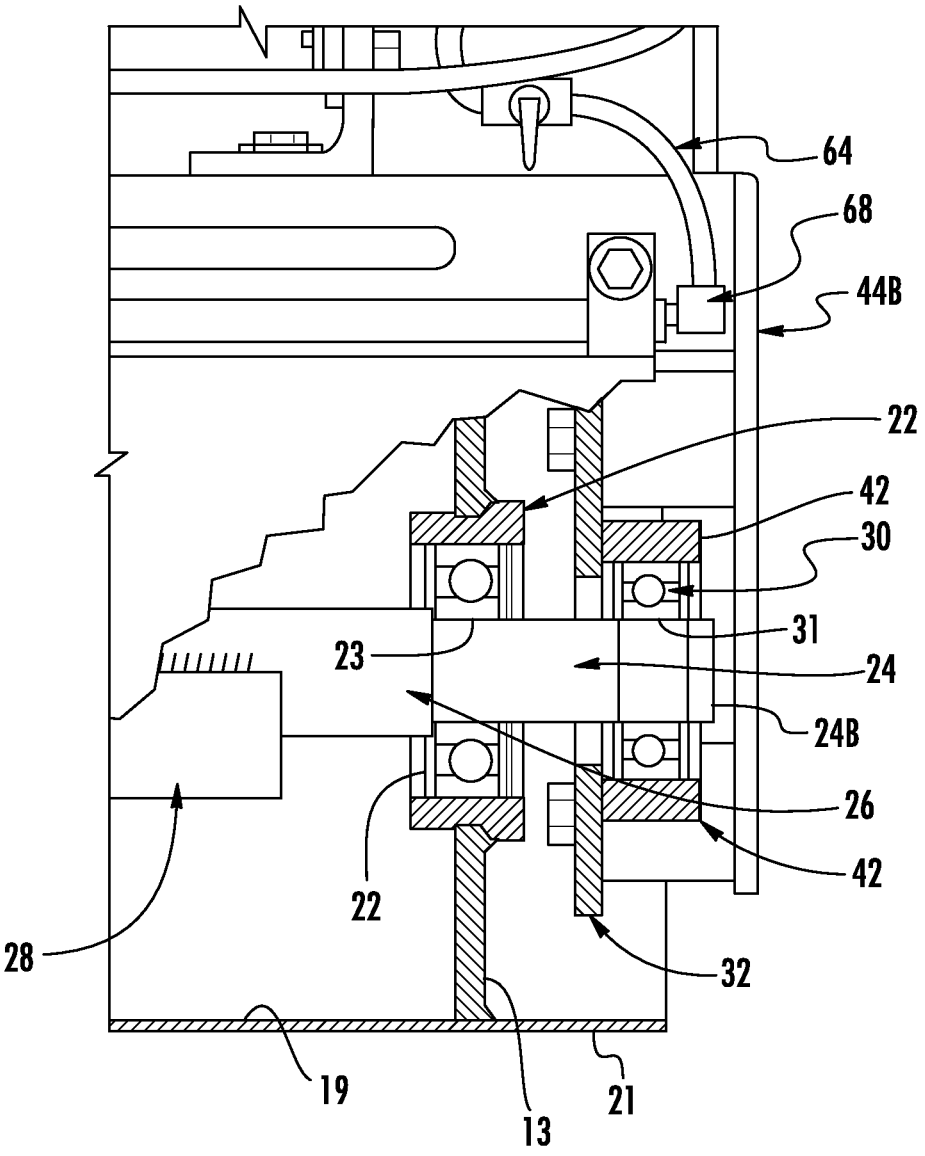
FIG. 3B is an enlarged close-up view of FIG. 3B, showing the shock absorbing structure and bearings in more detail.

FIGS. 2, 3A and 3B show in further detail the components included in a preferred embodiment of the vibratory pothole packer 10 of the present invention.

The frame and handle assembly 12 supports the vibratory drum assembly 14. In FIG. 2, the frame and handle assembly 12 includes a frame 41 that provides a housing in which or on which other components are secured.

FIG. 3A shows a front view of the preferred embodiment of the vibratory pothole packer and close-up view FIG. 3B, without the handle shown. The frame 41 has an outer wall that includes a first side plate 44A and a second side plate 44B, located on opposing sides of the frame 41, so that when a user stands behind the frame the first side plate 44A is on the user's right and the second side plate 44B is on the user's left. The frame also has a top wall 45 that connects the side plates 44A, 44B.

Below the mounting channel 46, the frame 41 supports the drum 20. The drum has a substantially cylindrical outer surface 21. This cylindrical outer surface 21 is substantially smooth, and allows a user to roll the drum along a paved surface. The outer surface 21 of the drum 20 also allows a user to form an even, smooth compacted surface of asphalt in a pothole.

To reduce weight of the drum 20, the drum includes a hollow cavity 17 defined by the inner surface 19 of the drum 20.

An eccentric shaft 24 is supported within cavity of the drum. The eccentric shaft has a first end 24A and a second end 24B, and it extends through the length of the cylindrical drum. As described in more detail herein, the eccentric shaft 24 has an overall center of mass that is positioned closer to one end of the shaft than to the other so that it is longitudinally offset from the center of the drum, as discussed in more detail herein. The eccentric shaft 24 is supported within the cavity 19 of the drum 20 by at least one set of drum bearings 22. In the preferred embodiment, there are two sets of drum bearings 22, with each set located towards a different end 24A, 24B of the eccentric shaft. Each set of drum bearings 22 is preferably secured to the inner surface 19 of the drum by annular support walls 13 so that the drum bearings 22 rotate with the drum. Each set of bearings 22 has an inner bearing surface 23 that is dimensioned and configured to support the eccentric shaft 24 so that the eccentric shaft 24 securely extends substantially along the center axis of the cylindrical drum 20. The eccentric shaft 24 engages the bearing surface 23 so that the eccentric shaft 24 can rotate with respect to the drum 20.

When the eccentric shaft 24 is rotated by the engine 40 at certain frequencies, as described in more detail below, it vibrates, and this vibration is transferred to the drum 20 through the bearing connection of the eccentric shaft 24 to the drum 20. This vibration of the drum 20 is useful for packing asphalt into a pothole.

To reduce the vibration that is transferred from the eccentric shaft 24 to the frame 41, which is engaged by the user, (or to prevent such transfer of vibration) the eccentric shaft 24 is supported on the frame 41 by shock absorbers 42. At least one shock absorber 42 is secured to at least one side plate 44A, 44B of the frame 41. A shock absorber plate 32 is secured to the shock absorber(s) 42, and a shock absorber plate bearing 30 is secured to each shock absorber plate 32 for supporting the eccentric shaft 24.

In the preferred embodiment, shown in FIGS. 3A and 3B, the drum is partially cutaway to show how the eccentric shaft is supported. A shock absorber 42 is secured to each respective side plate 44A, 44B. A pair of shock absorbers 42 supports a shock absorber plate 32 and a shock absorber plate bearing 30 towards the end 24B of the eccentric shaft 24. Each of the shock absorber plate bearings 30 has an inner shock absorber plate bearing surface 31 that is dimensioned and configured to securely support the eccentric shaft 24 within the respective shock absorber plate bearing and allow the eccentric shaft to rotate with respect to the frame while being translationally fixed with respect to the frame 41. The first and second shock absorber plate bearings 30 support the eccentric shaft 24 towards the first and second ends 24A, 24B of the eccentric shaft, respectively.

Though not shown, a similar shock absorber structure can be included to support the eccentric shaft at the other end 24A of the eccentric shaft 24.

The shock absorbers 42, the shock absorber plates 32, and the shock absorber bearings 30 are dimensioned, configured, and arranged to absorb vibration from the eccentric shaft 24 and to reduce the vibration that is transferred to the frame 41 and the engine 40. Because the user engages the frame 41, for example, by holding the handlebar 52, these shock absorbing structures also prevent the centrifugal force and vibration of the eccentric shaft 24 from being transferred to the user when the user grips the handlebar 52 or otherwise touches something secured to the frame 41.

The engine and drive assembly 16 powers the eccentric shaft 24 within the drum 20. The engine 40 can be a gasoline engine or an electric motor. Preferably, a gasoline engine 40 is mounted by fasteners 47 to the mounting channel 46 formed adjacent the top wall 45 of the frame 41, and the engine 40 rotates an engine shaft 48 with respect to the frame 41. A centrifugal clutch 38 is secured to the engine shaft 48 and is set to engage at a certain engine speed, so that rotation of the engine shaft can be linked to rotation of the centrifugal clutch 38. The centrifugal clutch 38 is rotatably connected to the sheave 34 on the eccentric shaft.

In the preferred embodiment, the sheave 34 is secured to the eccentric shaft 24. Preferably, the sheave 34 is secured to the eccentric shaft 24 by a key 80 that extends through a keyway 81 in the eccentric shaft 24 and a keyway 82 in the sheave 34 so rotation of the sheave 34 is linked to rotation of the eccentric shaft 24. A v-belt 36 is positioned and arranged to engage the sheave 34. Preferably, the v-belt 36 has a v-belt inner surface 37 that frictionally engages the outer surface 35 of the sheave 34, but other means of engagement are possible.

The v-belt 36 engages the centrifugal clutch 38 on the engine shaft 48, so that rotation of the centrifugal clutch 38 outer surface causes rotation of the v-belt 36. In the preferred embodiment, the outer surface 39 of the centrifugal clutch 38 frictionally engages the inner surface 37 of the v-belt 36, but other means of engagement are possible.

A first belt guard 90 extends laterally at least partially around the v-belt 36 and sheave 34, to protect the v-belt during operation. A second belt guard 92 extends laterally at least partially around the v-belt 36 and centrifugal clutch 38. Thus, the v-belt 36 is at least partially enshrouded by the belt guards 90, 92 and the frame 41, as shown in FIG. 2.

To allow a user to easily maneuver the vibratory pothole packer 10 and to use the vibratory pothole packer 10 as a user-pushed walk-behind unit, a handle 48 is secured to the mounting channel of the frame. The handle assembly includes a horizontal handlebar 52 that has a diameter that can be comfortably gripped by the hands of a user. The handlebar 52 is supported by side bars 51 that extend upwardly and rearwardly from the frame 41 of the pothole packer so that a user can grip the handlebar 52 and stand comfortably at a safe distance behind the drum 20 when pushing or pulling the vibratory pothole packer 10.

A user controls operation of the engine 40, to turn the engine 40 of the vibratory pothole packer 10 on and off, and to activate and deactivate the vibration of the eccentric shaft 24. The handle 48 preferably supports an engine throttle control 50, for controlling the amount of gasoline supplied to the engine. The handle 48 also preferably supports other controls for the engine, such as an on/off switch for the engine. A user can easily operate the controls on the handle to instantly turn the vibration on and off. To the handle 48 is attached the engine throttle control 50, for controlling the speed of the engine 40 and centrifugal force output of the eccentric shaft 24. The throttle control 50 is preferably located on or near a horizontal handlebar 52 of the handle 48. An on/off switch allows the user to turn on the engine and then to turn off the engine. When a user sets the engine to operate at an idling speed or below a critical speed, the engine shaft does not engage the centrifugal clutch, so there is no centrifugal force produced in the drum 20, allowing the operator to move the unit 10 from pothole to pothole without having the pothole packer jump around from the vibration shocks produced by the eccentric shaft 24. When a user sets the engine to operate at or above a critical speed, the centrifugal clutch 38 is engaged, causing the clutch 38 to rotate the v-belt 36, which in turn rotates the eccentric shaft 24 by way of the sheave 34 to effectuate the desired vibratory action. When the engine 40 is operating so that the engine shaft 48 rotational velocity is at or exceeds the critical speed, the speed of the eccentric shaft 24 is linked to the speed of the engine shaft 48. Thus, the user can increase or decrease the engine shaft 48 rotational velocity to increase or decrease the eccentric shaft 24 rotational velocity.

The higher the vibration frequency of the eccentric shaft, the more the asphalt would tend to behave like a liquid. With a lower vibration frequency and a higher amplitude of the vibration of the drum 20, the pothole packer 10 would be able to provide a greater packing effect. The operator of the potholer packer 10 operates the potholer packer 10 at a lower packing frequency for compacting the asphalt within the pothole. Then the operator regulates the frequency to adjust it from the packing frequency to a higher frequency that moves the asphalt, increases the density of the asphalt, and makes the upper surface of the asphalt smoother. It is undesirable to initially vibrate the drum 20 at a high frequency, because that can cause the drum 20 to sink into part of the pothole. When the drum 20 sinks into part of the pothole, an edge of the drum leaves depressions and ridges in the asphalt that are later difficult to smooth out.

When the speed of the eccentric shaft 24 is at a certain frequency or in a certain frequency range, the eccentric shaft 24 vibrates, resulting in vibration of the drum. Thus, the user can move the pothole packer 10 toward or over a patch of asphalt to be packed into a pothole, with the engine 40 either off or operating below a critical speed. Then the user can increase the speed of the engine 40 to meet or exceed the critical speed, and adjust the engine speed to cause a rotation of the eccentric shaft 24 at a frequency that results in vibration of the eccentric shaft.

This vibration of the drum 20 can be described by the amplitude of the vertical movement of the drum 20 during vibration, the vibrations per minute, and the centrifugal force produced.

The frame and handle assembly 12 also supports a kickstand 54, which depends from the handle assembly 12. The kickstand 54 is pivotable with respect to the frame 41 so that it can be pivoted from a first orientation to a second orientation. In the first orientation, shown in FIG. 1, the kickstand extends in a first direction so that a lower surface 55 of the kick stand 54 can engage a ground surface 100 on which the drum 20 of the vibratory pothole packer 10 rests. In the second orientation (not shown), the kickstand is refracted towards the frame 41 so that the vibratory pothole packer 10 can be easily maneuvered by a user along a surface.

In a first configuration of the exemplary embodiment, the outer surface 21 of the drum 20 has a 6 inch outer diameter and the drum 20 has a 12 inch length. In the first configuration, a 12 VDC 32 Amp electric motor can provide 1,600 pounds (7,120 Newtons) of centrifugal force at 5,000 vibrations per minute, with a compaction depth of up to 8 inches. This configuration has a weight of 97 pounds (44 Kg).

In a second configuration of the exemplary embodiment, the outer surface 21 of the drum 20 has an 8 inch diameter and a 12 inch length. In the second configuration, a 2.5 horsepower engine can provide 1,000 pounds (4,450 Newtons) of centrifugal force at 6,500 vibrations per minute, with a compaction depth of up to 8 inches. This configuration has a weight of 125 pounds (57 Kg). The engine can run at 3,400 revolutions per minute.

It is also possible for the engines with other outputs, such as an engine with 3.5 horsepower.

The water tank and sprinkler system 18 provide water (or another fluid) to wet down the asphalt to be compacted, so the asphalt is less likely to stick to the drum 20. The water tank 60 is secured by fasteners 62 to the mounting channel 46 adjacent to the top wall 45 of the frame 41. The water tank 60 has a reservoir that is useful for containing water, or another fluid, which can be directed onto the drum 20 or the asphalt when the drum is being used for compacting asphalt on a surface 100. A hose 64 connects the water tank 60 to a sprinkler pipe 66 that is secured to the mounting channel 46. The sprinkler pipe 66 is secured to the mounting channel 46 and is positioned adjacent to the drum 20. The sprinkler pipe has an outer wall with an outer pipe surface that extends substantially along the length of the drum 20. At least one hole is defined on the outer pipe surface of the sprinkler pipe to spray the drum 20. Each hole is configured and arranged to direct a fluid from within the sprinkler pipe through the outer pipe surface toward the drum 20.

A shutoff valve 68 is attached to the sprinkler pipe 66. A user can set the shutoff valve 68 to an on position in which fluid can flow from the hose 64 into the sprinkler pipe 66. A user can alternatively set the shutoff valve 68 to an off position in which fluid cannot flow from the hose 64 into the sprinkler pipe 66. For example, a user may wish to stop flow of a fluid from the tank 60 when the user is not using the unit 10 to compact asphalt in a pothole.

The reservoir has a spout 65 that is connected to the first end of the hose 64. The second end of the hose 64 is secured to an open end of the sprinkler pipe 66. These connections are fluid connections, and are each sealed to prevent leakage. These connections allow the fluid to flow from the reservoir of the water tank 60, through the spout 65, through the hose 64, and finally into the sprinkler pipe 66.

The vibratory pothole packer 10 is also configured so that it has a tendency to travel in a straight path when it moves in forward and reverse directions along a surface 100, such as a road. Thus, when the user wants to move the pothole packer 10 in a forward or a reverse direction in a straight path, the user pushes or pulls the vibratory pothole packer 10 in that direction, and the pothole packer 10 turns left or right only when the user steers the pothole packer 10 in the respective direction. This tendency for straight forward and back motion is a result of the configuration and arrangement of the components of the pothole packer 10. In particular, if the weight of the pothole packer 10 is not properly distributed about the frame 41, the pothole packer 10 will have a tendency to move in a circular path, turning towards either the left or right side of the frame 41, depending on which side bears most of the weight, which in most embodiments is on the side of the engine 40. For example, if most of the weight of the pothole packer 10 is located toward the left side of the frame 41, the pothole packer 10 will tend to turn left when moving forward.

If the engine center of mass is fixed and the center of mass of the eccentric weight is in the middle of the shaft, by increasing the vibration frequency and the centrifugal force, the circle the unit tends to travel in decreased. As the frequency and force decreased, the circle diameter increases.

Another benefit of the evenly balanced pothole packer 10 of the present invention is that the vibratory pothole packer 10 also provides a smooth surface on the asphalt when it compacts the asphalt. An unbalanced pothole packer causes the edge of the drum 20 on the side of the greater weight, such as the side of the engine 40, to dig down into the asphalt move part of it out of the pothole and create a ridge in the asphalt. It is time consuming to remove this ridge and to form a smooth transition between the asphalt in the pothole and the other asphalt surface on the road. To prevent such an uneven surface, the vibratory pothole packer of the present invention balances the weight of engine 40 with additional weight towards the opposite end of the frame from the engine.

Additional dead weight to balance the vibratory pothole packer is undesirable because it makes the unit 10 heavier and less maneuverable. Instead, to balance the vibratory pothole packer 10 of the present invention, the vibration frequency and the position of the eccentric on the drive shaft 24 are configured so that the centrifugal force created, the frequency, the weight of the frame 41, the location of the engine 40 weight and the location of the eccentric mass on the eccentric shaft cooperate to bias the unit 10 to travel along a surface 100 in a straight line.

Figure 4:
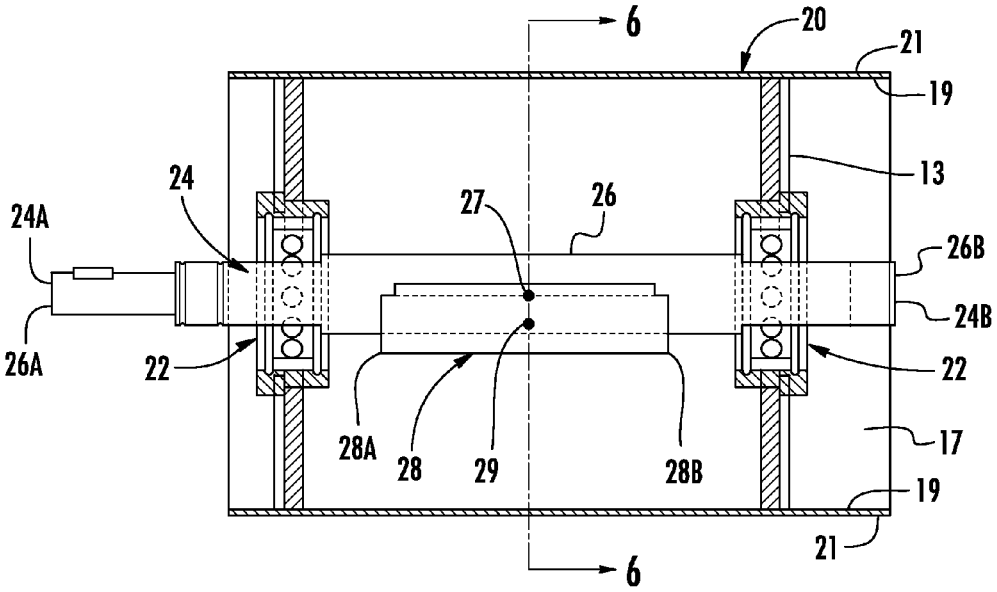
FIG. 4 is a cutaway view of a first embodiment of a drum assembly having an eccentric mass with its center of mass that is not longitudinally offset.
Figure 5:
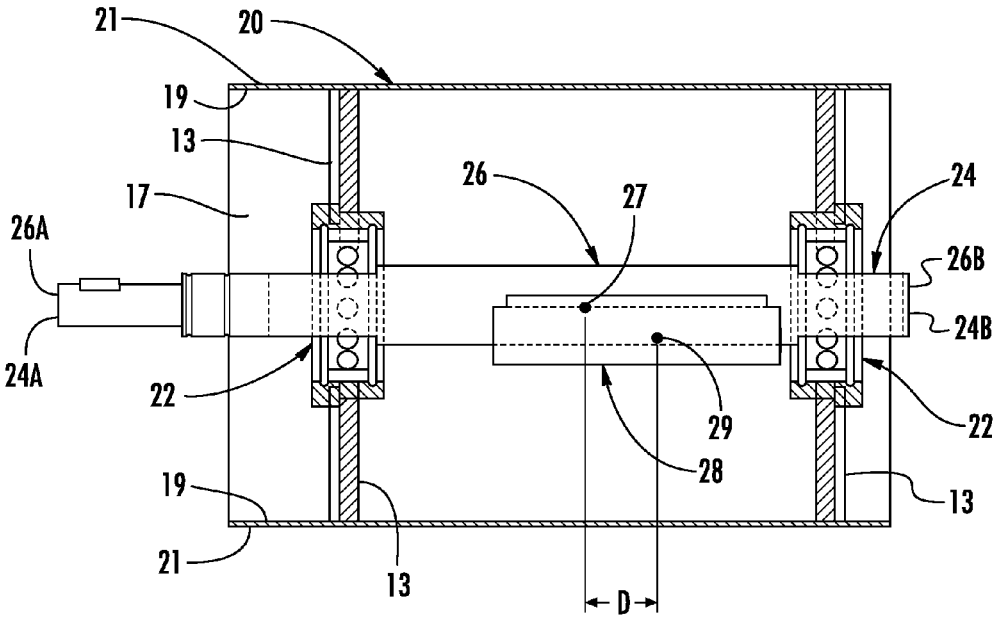
FIG. 5 is a cutaway view of a second embodiment of a drum assembly having an eccentric shaft with a longitudinally offset center of mass.

FIGS. 4 and 5 show different embodiments of drum assemblies that could be supported on the frame. Each embodiment includes an eccentric shaft 24 that has a drum shaft 26 to which an eccentric weight 28 is secured.

In FIG. 4, the eccentric weight 28 has a center of mass 29 that is not longitudinally offset from the center of mass 27 of the drum shaft 26. When such an eccentric shaft 24 is rotated so it vibrates, the drum assembly causes the vibratory pothole packer 10 to turn in a circle. This is undesirable.

In this embodiment, the drum shaft 26 has a first end 26A and a second end 26B. The center of mass 27 of the drum shaft 26 is positioned between the first and second ends 26A, 26B toward the center of the drum 20, and is positioned along the central axis of the drum shaft 26. The overall center of the eccentric shaft 24 is offset from its geometric center.

FIG. 5 shows a second embodiment of a drum assembly 14 in which the center of mass 29 of the eccentric weight is longitudinally offset by a longitudinal distance D from the center of mass 27 of the drum shaft 26, away from the end 24A of the eccentric shaft 24, and toward end 24B of the eccentric shaft 24. End 24A is located on the side of the frame where the most weight on the frame is located. In FIG. 3A, the side of the frame where most of the weight is located is the side of the frame that supports the engine. The distance D by which the eccentric weight 28 is longitudinally offset is optimized so the vibratory pothole packer 10 is biased to travel in a straight line along a surface when the eccentric shaft 24 is vibrating and when the vibratory pothole packer 10 is moving forward or back on a surface 100. In particular, the center of mass 29 of the eccentric weight 28 is longitudinally offset so that the centrifugal force created by the eccentric shaft 24 compensates for the longitudinally offset center of mass of the frame and engine. Thus, the preferable longitudinal offset of the eccentric weight depends on the centrifugal force created by the eccentric shaft, the vibration frequency of the eccentric shaft, the engine weight, and the position of the engine on the frame.

In FIG. 3A, the location of the center of mass of the eccentric weight on the drum shaft is preferably offset on the drum shaft towards side plate 44B, and away from side plate 44A. Typically to find the preferable location of the eccentric weight on the drum shaft that allows the vibratory pothole packer 10 to be biased to travel in a straight line when pushed from behind, the center of gravity of the entire unit 10 must be calculated. Once the center of gravity of the entire unit 10 is found, the preferable center of gravity of the eccentric shaft is located, and the eccentric weight 28 is secured to the drum shaft 26 at that point. There are many variables that go into calculating the center of gravity of the pothole packer 10, such as the weight and location of the water tank 60, the amount of water typically stored in the water tank 60, the location of the water within the water tank 60, the weight and location of other components on the pothole packer 10, the force of the drum 20 created at different frequencies, the consistency of the asphalt, and other variables.

Because the engine 40 is typically a heavier component relative to the other components of the pothole packer 10, the eccentric weight 28 is typically offset toward the end of the drum shaft 26 that is opposite the engine 40.

The eccentric weight's center of mass 29 and the drum shaft's center of mass 27 together define the eccentric shaft's center of mass. In the exemplary embodiment, the eccentric shaft's center of mass is thus longitudinally offset from the drum shaft's center of mass 27, the center of the eccentric shaft, and, the longitudinal center of the drum. The eccentric shaft's center of mass balances the vibratory pothole packer 10. Without a longitudinally offset center of mass on the eccentric shaft 24, the vibratory pothole packer would be heavier on the side of the frame that supports the engine, because the engine 40 is typically heavier than the reservoir 60. The longitudinal offset of the eccentric shaft's center of mass is designed according to the overall configuration of the vibratory pothole packer 10. For example, a vibratory pothole packer 10 with a heavier engine 40 or an engine 40 center of mass that is further longitudinally offset requires a greater longitudinal offset of the eccentric shaft's center of mass.

Figure 6:
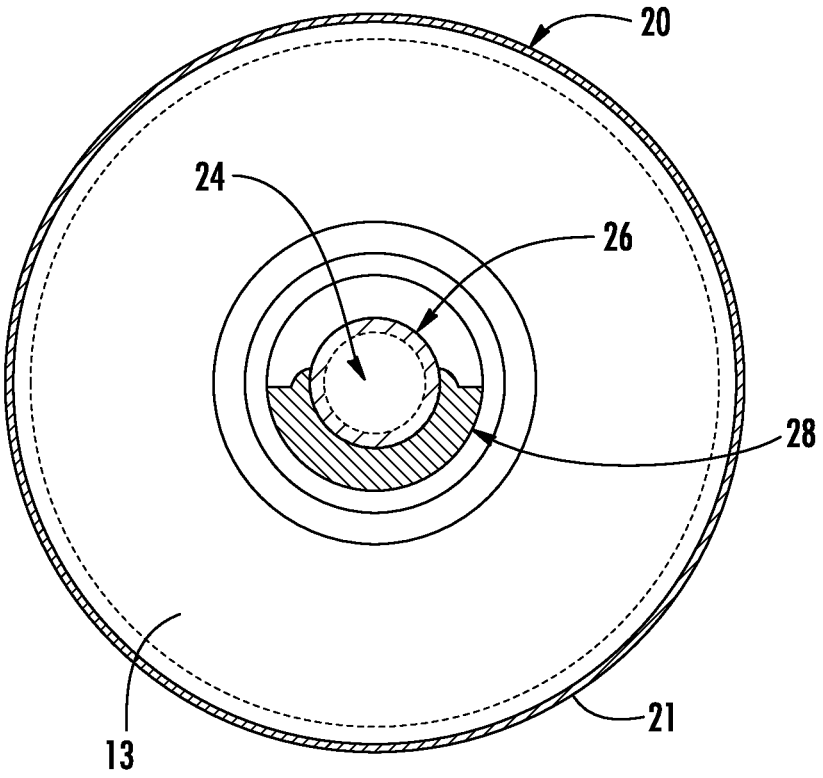
FIG. 6 is a side cross sectional view through the lines A-A of FIG. 4.

The eccentric shaft 24 can be formed of various designs that have a center of mass that is offset from the center of the shaft within the drum. The eccentric shaft 24 is preferably a cylindrical drum shaft 26 to which an eccentric weight 28 is secured. The eccentric weight 28 preferably has a crescent cross-sectional profile, as shown in FIG. 6, with a semicircular outer surface and a semicircular inner surface when viewed from one of its ends. The eccentric weight 28 has a first end 28A and a second end 28B. The distance from the first end 28A to the second end 28B of the eccentric weight 28 is less than the distance from the drum shaft's first end 26A to the drum shaft's second end 26B. The inner surface of the eccentric weight 28 is configured to securely engage a portion of the cylindrical outer surface of the drum shaft 26. The eccentric weight 28 is preferably welded to the outer surface of the drum shaft 26. The eccentric weight 28 has a center of mass 29 that is equidistant between the eccentric weight's first end 28A and the eccentric weight's second end 28B. The eccentric weight 28 is positioned along the drum shaft so that the eccentric weight's center of mass 29 is longitudinally offset from the drum shaft's center of mass 27 by a distance D, as shown in FIG. 5.

The respective centers of mass 27, 29 that are shown in FIGS. 4-5 are located within the area defined by the geometry of the respective parts. They are not necessarily positioned on the surfaces in the drawings. For example, the center of mass 27 of the drum shaft is located along the central axis of the shaft, and FIG. 4 shows its coordinates as viewed from the front of the vibratory pothole packer 10. Similarly, the location of center of mass 29 of the eccentric mass is shown in FIG. 4 to illustrate its relative position with respect to the drum shaft when viewed from the front.

The exemplary embodiment of the present invention can be configured in various ways. Preferably, the weight of the device is in the range of 90-130 pounds. Preferable configurations have weights of 97 pounds and 125 pounds.

It can therefore be seen that the vibratory pothole packer of the present invention provides a vibratory pothole packer that is small and easily portable to work sites where only a single pothole needs to be filled; provides a vibratory pothole packer that is cost-effectively transportable to work sites where only a single pothole needs to be filled; provides a vibratory pothole packer that can be easily maneuvered by a single person; provides a vibratory pothole packer that provides a smooth upper surface of asphalt packed in a pothole; provides a vibratory pothole packer that is biased towards movement in a substantially straight path along a surface when a user pushes or pulls the pothole packer along the surface; and provides a vibratory pothole packer that sufficiently compacts asphalt within a pothole to maximize the life length of time before the pothole will require further repair. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A vibratory pothole packer, comprising:

a frame having an outer frame wall, the frame further having a mounting channel, and the outer frame wall further comprising at least one side plate secured to the mounting channel;

an engine secured to the mounting channel, the engine further comprising an engine shaft;

at least one shock absorber secured to the at least one side plate;

at least one shock absorber plate secured to the at least one shock absorber;

at least one set of shock absorber plate bearings secured to the at least one shock absorber plate;

a drum, the drum having an outer wall with a substantially cylindrical outer surface, the outer wall having an inner surface that defines a cavity within the drum;

an eccentric shaft, the eccentric shaft having a first end and a second end, the eccentric shaft having a center of mass that is positioned closer to the first end of the eccentric shaft than to the second end of the eccentric shaft, the eccentric shaft being supported within the cavity of the drum by at least one set of drum bearings that are secured to the drum; and the eccentric shaft being supported by the shock absorber plate bearings, whereby the at least one shock absorber and at least one shock absorber plate prevent vibration from the centrifugal force of the eccentric shaft to travel into the frame and the engine wherein the rotation of the engine shaft can be selectively linked to the rotation of the eccentric shaft.

2. The vibratory pothole packer of claim 1, further comprising:

a sheave secured to the eccentric shaft; and a v-belt positioned and arranged to engage the sheave on the eccentric shaft;

wherein the engine further comprises a centrifugal clutch secured to the engine shaft, the centrifugal clutch being configured to engage at a certain engine speed;

wherein the engine is configured to be selectively operable at an idling speed that does not engage the centrifugal clutch, and the engine is further configured to be selectively operable at the certain engine speed that does engage the centrifugal clutch; and further wherein the v-belt is positioned and arranged to engage the centrifugal clutch, whereby the rotation of the engine shaft can be selectively linked to the rotation of the eccentric shaft.

3. The vibratory pothole packer of claim 1, further comprising:

a handle assembly secured to the mounting channel;

an engine throttle control connected to the handle assembly; and a kick stand secured to the handle assembly, the kick stand being selectively pivotable to an orientation in which it supports the unit in an upright position.

4. The vibratory pothole packer of claim 1, further comprising:

a water tank secured to the mounting channel;

a hose having a first end and a second end, the first end being secured to a spout on the water tank, the spout and hose being configured so a fluid in the tank can flow from the tank through the spout into the hose, a sprinkler pipe secured to the mounting channel, the sprinkler pipe having a pipe wall with an outer pipe surface, the second end of the hose being secured to an open end of the pipe so a fluid can flow from the hose into the sprinkler pipe;

at least one hole defined on the outer pipe surface of the sprinkler pipe, the at least one hole being configured and arranged to direct a fluid from within the sprinkler pipe through the outer pipe surface toward the drum.

5. The vibratory pothole packer of claim 4, further comprising:

a shutoff valve connected to the sprinkler pipe for selectively allowing a fluid to flow into the sprinkler pipe from the hose.

6. The vibratory pothole packer of claim 1, wherein the eccentric shaft further comprises a drum shaft and an eccentric weight secured to the drum shaft, the eccentric shaft having a first end and a second end, the weight being positioned closer to the first end of the eccentric shaft than to the second end of the eccentric shaft.

7. The vibratory pothole packer of claim 6, wherein the eccentric weight is welded to the drum shaft.

8. The vibratory pothole packer of claim 1, wherein the at least one shock absorber comprises rubber.

9. A vibratory pothole packer, comprising:

a frame having an outer frame wall, the frame further having a mounting channel, and the outer frame wall further comprising a first side plate and a second side plate, each side plate being secured to the mounting channel;

an engine secured to the mounting channel, the engine further comprising an engine shaft;

at least one shock absorber secured each of the side plates;

a first shock absorber plate secured to the respective at least one shock absorber that is secured to the first side plate, and a second shock absorber plate secured to the respective at least one shock absorber that is secured to the second side plate;

a first set of shock absorber plate bearings secured to first shock absorber plate;

a second set of shock absorber plate bearings secured to second shock absorber plate;

a drum, the drum having an outer wall with a substantially cylindrical outer surface, the outer wall having an inner surface that defines a cavity within the drum;

an eccentric shaft, the eccentric shaft having a first end and a second end, the eccentric shaft having a center of mass that is positioned closer to the first end of the eccentric shaft than to the second end of the eccentric shaft;

the eccentric shaft being supported within the cavity of the drum by a first set of drum bearings that are secured to the drum and a second set of drum bearings that are secured to the drum, the first set of drum bearings supporting the eccentric shaft towards the first end of the eccentric shaft, and the second set of drum bearings supporting the eccentric shaft towards the second end of the eccentric shaft; and the eccentric shaft being supported on the frame by the first and second sets of shock absorber plate bearings, the first set of shock absorber plate bearings supporting the eccentric shaft towards the first end of the eccentric shaft, and the second set of shock absorber plate bearings supporting the eccentric shaft towards the second end of the eccentric shaft, whereby the respective shock absorber and the respective shock absorber plate prevent vibration from the centrifugal force of the eccentric shaft to travel into the frame and the engine;

wherein the rotation of the engine shaft can be selectively linked to the rotation of the eccentric shaft.

10. The vibratory pothole packer of claim 9, further comprising:

a sheave secured to the eccentric shaft; and a v-belt positioned and arranged to engage the sheave on the eccentric shaft;

wherein the engine further comprises a centrifugal clutch secured to the engine shaft, the centrifugal clutch being configured to engage at a certain engine speed;

wherein the engine is configured to be selectively operable at an idling speed that does not engage the centrifugal clutch, and the engine is further configured to be selectively operable at the certain engine speed that does engage the centrifugal clutch; and further wherein the v-belt is positioned and arranged to engage the centrifugal clutch, whereby the rotation of the engine shaft can be selectively linked to the rotation of the eccentric shaft.

11. The vibratory pothole packer of claim 9, further comprising:

a handle assembly secured to the mounting channel;

an engine throttle control connected to the handle assembly; and a kick stand secured to the handle assembly, the kick stand being selectively pivotable to an orientation in which it supports the unit in an upright position.

12. The vibratory pothole packer of claim 9, further comprising:

a water tank secured to the mounting channel;

a hose having a first end and a second end, the first end being secured to a spout on the water tank, the spout and hose being configured so a fluid in the tank can flow from the tank through the spout into the hose, a sprinkler pipe secured to the mounting channel, the sprinkler pipe having a pipe wall with an outer pipe surface, the second end of the hose being secured to an open end of the pipe so a fluid can flow from the hose into the sprinkler pipe;

at least one hole defined on the outer pipe surface of the sprinkler pipe, the at least one hole being configured and arranged to direct a fluid from within the sprinkler pipe through the outer pipe surface toward the drum.

13. The vibratory pothole packer of claim 12, further comprising:

a shutoff valve connected to the sprinkler pipe for selectively allowing a fluid to flow into the sprinkler pipe from the hose.

14. The vibratory pothole packer of claim 9, wherein the eccentric shaft further comprises a drum shaft and an eccentric weight secured to the drum shaft, the eccentric shaft having a first end and a second end, the weight being positioned closer to the first end of the eccentric shaft than to the second end of the eccentric shaft.

15. The vibratory pothole packer of claim 14, wherein the eccentric weight is welded to the drum shaft.

16. The vibratory pothole packer of claim 9, wherein the at least one shock absorber comprises rubber.

* * * * *